US009984555B2

(12) United States Patent
Bieser

(10) Patent No.: US 9,984,555 B2
(45) Date of Patent: May 29, 2018

(54) MOBILE SECURITY SYSTEM AND METHOD

(71) Applicant: Gregg E Bieser, Highland Park, IL (US)

(72) Inventor: Gregg E Bieser, Highland Park, IL (US)

( * ) Notice: Subject to any disclaimer, the term of this patent is extended or adjusted under 35 U.S.C. 154(b) by 266 days.

(21) Appl. No.: 14/875,243

(22) Filed: Oct. 5, 2015

(65) Prior Publication Data

US 2016/0098916 A1 Apr. 7, 2016

Related U.S. Application Data

(60) Provisional application No. 62/059,944, filed on Oct. 5, 2014.

(51) Int. Cl.

| | |
|---|---|
| ***G08B 1/08*** | (2006.01) |
| ***G08B 25/10*** | (2006.01) |
| ***G08B 19/00*** | (2006.01) |

(52) U.S. Cl.

CPC ..... *G08B 25/10* (2013.01); *G08B 19/00* (2013.01)

(58) Field of Classification Search

CPC ..... G08B 25/10; G08B 19/00; G08B 21/02; G08B 21/0202; G08B 21/0227; G08B 21/0258; G08B 21/0266; G08B 21/24

See application file for complete search history.

(56) References Cited

U.S. PATENT DOCUMENTS

| | | | | |
|---|---|---|---|---|
| 6,154,130 | A * | 11/2000 | Mondejar | G08B 13/08 340/321 |
| 2002/0116651 | A1* | 8/2002 | Beckert | G06F 1/30 713/300 |
| 2012/0274447 | A1* | 11/2012 | Hess | G08B 13/191 340/8.1 |
| 2013/0109342 | A1* | 5/2013 | Welch | B60N 2/002 455/404.2 |
| 2015/0242665 | A1* | 8/2015 | Antonescu | G06K 19/0724 340/8.1 |
| 2015/0356862 | A1* | 12/2015 | Daoura | G08B 25/10 340/686.6 |

* cited by examiner

*Primary Examiner* — Ryan Sherwin
(74) *Attorney, Agent, or Firm* — Neal, Gerber & Eisenberg LLP

(57) ABSTRACT

Embodiments relate to a mobile security device, system and method. The mobile security device includes a base and at least one sensor. The base has a housing defining a first end and a second end. The base includes a base power source and a base controller coupled to the base power source and configured for wireless communication. The at least one sensor is removably coupled to the first end of the base and communicates therewith. The at least one sensor is configured to provide at least one of motion sensing, CO2/smoke sensing, vibration sensing, light sensing, and temperature/humidity sensing. The at least one sensor includes a sensor housing; a sensor power source; and a sensor controller coupled to the sensor power source and configured for wireless communication.

32 Claims, 11 Drawing Sheets

MOBILE SECURITY SYSTEM AND METHOD

CLAIM FOR PRIORITY

This application claims priority from U.S. Provisional Application Ser. No. 62/059,944 filed Oct. 5, 2014, the complete subject matter of which is incorporated herein by reference in its entirety.

FIELD OF THE INVENTION

The invention relates generally to a security device. More specifically, the present invention relates to a portable, mobile security device, system and method.

BACKGROUND OF THE INVENTION

Embodiments of the present invention relate to security. Few human needs are as fundamental and timeless as personal safety and security . . . and few have been more explosively changed by the proliferation of smart phones and the recent realization of device "connectedness" technologies. Witness the rise of remote access keyless locks, Internet-ready multi-sensor security systems, and even "smart home" automation and awareness hubs . . . it's an old itch with a new scratch.

But these advances are centered around the home and people are not . . . people are in motion . . . people travel . . . and whether to a local office or a distant city, whether on business or on pleasure, whether for just the day or many weeks, risk travels with them . . . risk of theft in-transit, risk of intrusion on-site, risk of undetected catastrophe . . . and far from the security of home.

For the foregoing reasons, it would be desirable to provide a mobile device, system and method that is easy to use. It would be desirable to provide a fully self-contained, compact, multi-sensor security system designed specifically for security on the move. It would be even more desirable to provide supplemental awareness of specific security risks (motion, smoke/CO, sound, light, and the like and inform the user via ALERTs (text/e-mail), ALARMs (audio), both or through some other means.

SUMMARY OF THE INVENTION

Embodiments relate to a fully self-contained, compact, multi-sensor security system designed specifically for security on the move. The base can stand alone, providing motion detection, visuals via an optional camera, and in-transit monitoring of belongings. If a security event occurs, the system informs the user via ALERTs (text/e-mail), ALARMs (audio), both or through some other means. For more comprehensive protection, add one or more tiny wireless sensors, each sensor providing supplemental awareness of specific security risks (motion, smoke/CO, sound, light, and the like). The base monitors these elements, reporting immediately when security issues occur. When not in use, these elements lock onto the base for travel convenience and charge their batteries from the base power source.

Embodiments relate to a mobile security device, system and method. The device includes a base and at least one sensor. The base has a housing defining a first end and a second end. The base includes a base power source and a base controller coupled to the base power source and configured for wireless communication. The at least one sensor is removably coupled to the first end of the base and communicates therewith. The at least one sensor is configured to provide at least one of motion sensing, CO2/smoke sensing, vibration sensing, light sensing, and temperature/humidity sensing. The at least one sensor includes a sensor housing; a sensor power source; and a sensor controller coupled to the sensor power source and configured for wireless communication.

Another embodiment relates to a mobile security system including a base, first, second and third sensors, and first and second proximity tags. The base has a housing defining a first end and a second end, and includes a base power source; a base controller coupled to the power source and configured for wireless communication; a speaker coupled to at least one of the base power source and the base controller; and a camera coupled to at least one of the base power source and the base controller. The first sensor is removably coupled to the first end of the base and communicates therewith, the first sensor is configured to provide at least one of motion sensing, CO2/smoke sensing, vibration sensing, light sensing, and temperature/humidity sensing, where the first sensor includes a first sensor housing; a first sensor power source; and a first sensor controller coupled to the first sensor power source and configured for wireless communication. The second sensor is removably coupled proximate the first end of the base and communicates therewith, the second sensor is configured to provide at least one of motion sensing, CO2/smoke sensing, vibration sensing, light sensing, and temperature/humidity sensing, the second sensor including a second sensor housing; a second sensor power source; and a second sensor controller coupled to the power source and configured for wireless communication. The third sensor is removably coupled proximate the first end of the base and communicates therewith, the third sensor is configured to provide at least one of motion sensing, CO2/smoke sensing, vibration sensing, light sensing, and temperature/humidity sensing, the third sensor including a third sensor housing; a third sensor power source; and a third sensor controller coupled to the third sensor power source and configured for wireless communication. The first proximity tag is adapted to attach to a bag and/or belongings and communicates with at least the base, the first proximity tag configured to provide approximate distance-from-base information, the first proximity tag including a first proximity tag housing; a first proximity tag power source; and a first proximity tag controller coupled to the first proximity tag power source and configured for wireless communication. The second proximity tag is adapted to attach to a bag and/or belongings and communicates with at least the base, the second proximity tag configured to provide approximate distance-from-base information, the second proximity tag includes a second proximity tag housing; a second proximity tag power source; and a second proximity tag controller coupled to the second proximity tag power source and configured for wireless communication.

Yet another embodiment relates to a method for providing security using a mobile security device, the mobile security device including a base and at least one proximity tag. The base has a housing defining a first end and a second end, and includes a base power source; a base controller coupled to the base power source and configured for wireless communication; a speaker coupled to at least one of the base power source and the base controller; a camera coupled to at least one of the base power source and the base controller; and a touch pad coupled to at least one of the base power source and the base controller. The at least one proximity tag is configured to attach to a bag and/or belongings and communicate with the base. The at least one proximity tag is configured to provide approximate distance-from-base information, the at least one proximity tag including a proximity tag housing; a proximity tag power source; a proximity tag controller coupled to the proximity tag power source and configured for wireless communication. The method includes independently powering-up the at least one proximity tag; placing the at least one proximity tag on a bag and/or belongings; initiating proximity monitoring from the base; arming the base and the at least one proximity tag; monitoring the at least one proximity tag for proximity states; and base ALARMing and ALERTing when changes in proximity state of the at least one proximity tag occur.

Still another embodiment relates to a method for providing security using a mobile security device. The mobile security device includes a base and a sensor. The base has a housing defining a first end and a second end, and includes a base power source; a base controller coupled to the base power source and configured for wireless communication; a speaker coupled to at least one of the base power source and the base controller; a camera coupled to at least one of the base power source and the base controller; and a touch pad coupled to at least one of the base power source and the base controller. The at least one sensor is removably coupled to the first end of the base and communicates therewith, the at least one sensor configured to provide at least one of motion sensing, CO2/smoke sensing, vibration sensing, light sensing, and temperature/humidity sensing. The at least one sensor includes a sensor housing; a sensor power source; and a sensor controller coupled to the sensor power source and configured for wireless communication. The method includes detaching the at least one sensor auto-activating the sensor; positioning the at least one sensor to at least one risk point in a security zone; initiating at least one of watch-only and watch-and-warn sensor monitoring from the base; arming the base and the at least one sensor; monitoring the at least sensor for heartbeats; monitoring the at least sensor for security events; performing at least one of base ALERTing, base ALARMing and base ALERTing and ALARMing when missed heartbeats or security events occur in the at least one sensor; and disarming the base and the at least one sensor.

The foregoing and other features and advantages of the invention will become further apparent from the following detailed description of the presently preferred embodiment, read in conjunction with the accompanying drawings. The drawings are not to scale. The detailed description and drawings are merely illustrative of the invention rather than limiting, the scope of the invention being defined by the appended claims and equivalents thereof.

BRIEF DESCRIPTION OF THE DRAWINGS

Throughout the various figures, like reference numbers refer to like elements.

DETAILED DESCRIPTION OF PRESENTLY PREFERRED EMBODIMENTS

Figure 1:
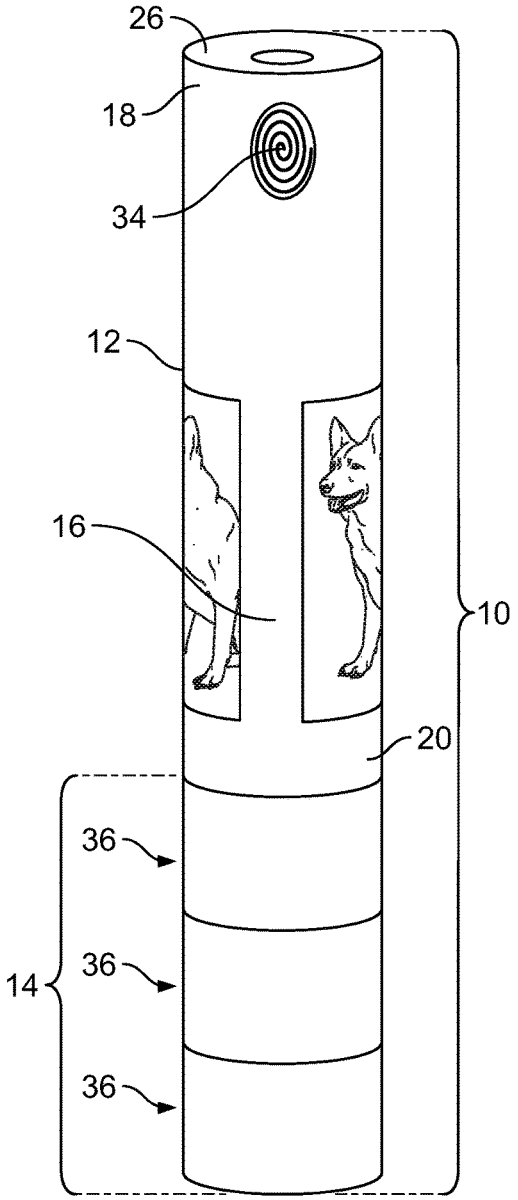
FIG. 1 illustrates a front view of the device in accordance with one embodiment of the present invention.
Figure 2:
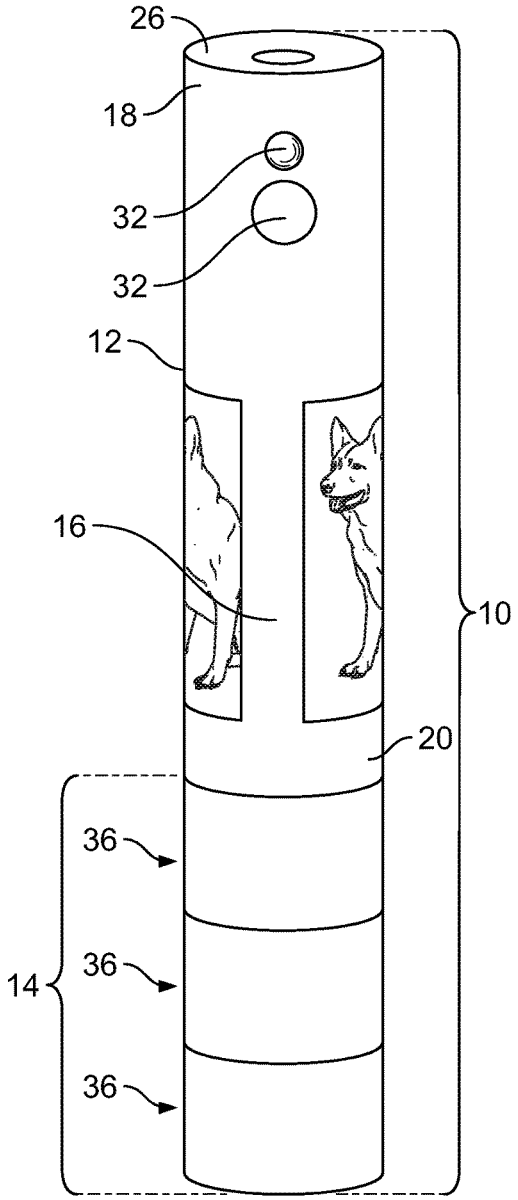
FIG. 2 illustrates a back view of the device of FIG. 1 in accordance with one embodiment of the present invention.

Few human needs are as fundamental and timeless as personal safety and security . . . and few needs have been more explosively changed by the proliferation of smart phones and the recent realization of device "connectedness" technologies. Witness the rise of remote access keyless locks, Internet-ready multi-sensor security systems, and even "smart home" automation and awareness hubs . . . it's an old itch with a new scratch. Embodiments of the present invention scratch that itch. Embodiments of the present invention relate to personal safety and security. More specifically embodiments of the present invention relate to a portable, mobile security system and method.

FIGS. 1-5 depict a mobile security device, generally designated 10, in accordance with one embodiment of the present invention. In at least one embodiment, the mobile security system 10 operates in one or more modes: TRAVEL (proximity monitoring for proximity tags); SURVAIL (silent observation—ALERTs but no ALARMs); and SECURE (full "watch-and-warn" security system—ALERTs and ALARMs). The mobile security system 10 includes a rapid deploy and arm sequence (less than 30 seconds from assembled "inert" system to actively monitoring) providing personal safety and security.

The illustrated mobile security device 10 is relatively small, with a diameter of about 1.5" and an overall length of about 8.5" and able to fit in about any bag or purse. As depicted, the mobile security system 10 includes a base 12 (having a length of about 5.5") and one or more elements 14, each element about 1" in length. FIGS. 1-5 depict the mobile security device 10 having an elongated, cylindrical-like shape, although other shapes are contemplated.

FIGS. 1-5 depict the base 12 having a housing 16 defining a second end 18 and a first end 20. FIG. 1 depicts the mobile security device 10 having an elongated, cylindrical-like shape which minimizes "catching" on bag/contents, minimizing the risk of damage to the bag/contents, although other shapes are contemplated. Further housing 16 has an anti-slip exterior finish that resists scratches. It should be appreciated that the dimensions and exterior are illustrative only, and other sizes and dimensions are contemplated.

Figure 3:
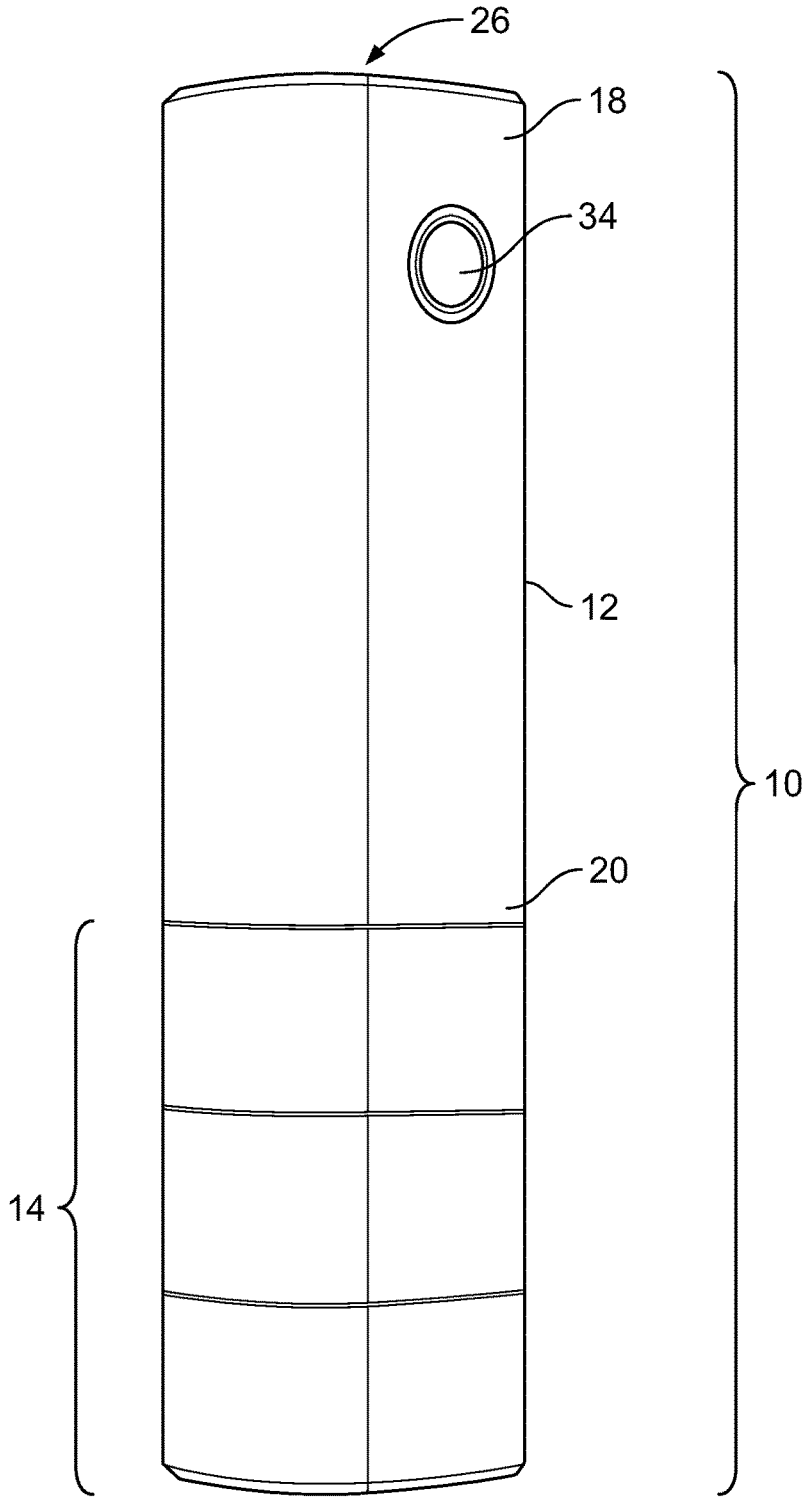
FIG. 3 illustrates a front perspective view of the device of FIG. 1 in accordance with one embodiment of the present invention.
Figure 4:
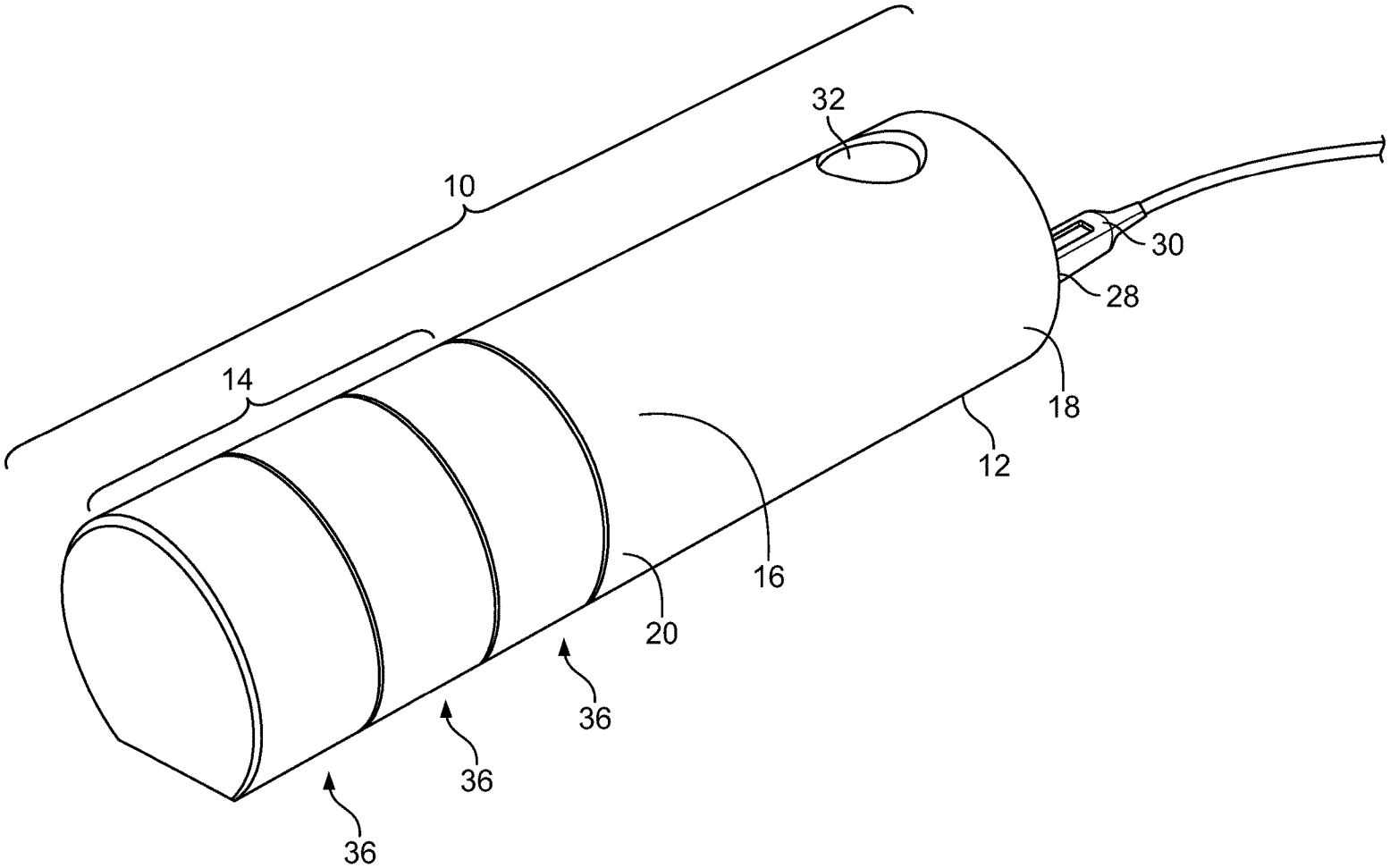
FIG. 4 illustrates another front perspective view of the device of FIG. 1 in accordance with one embodiment of the present invention.
Figure 5:
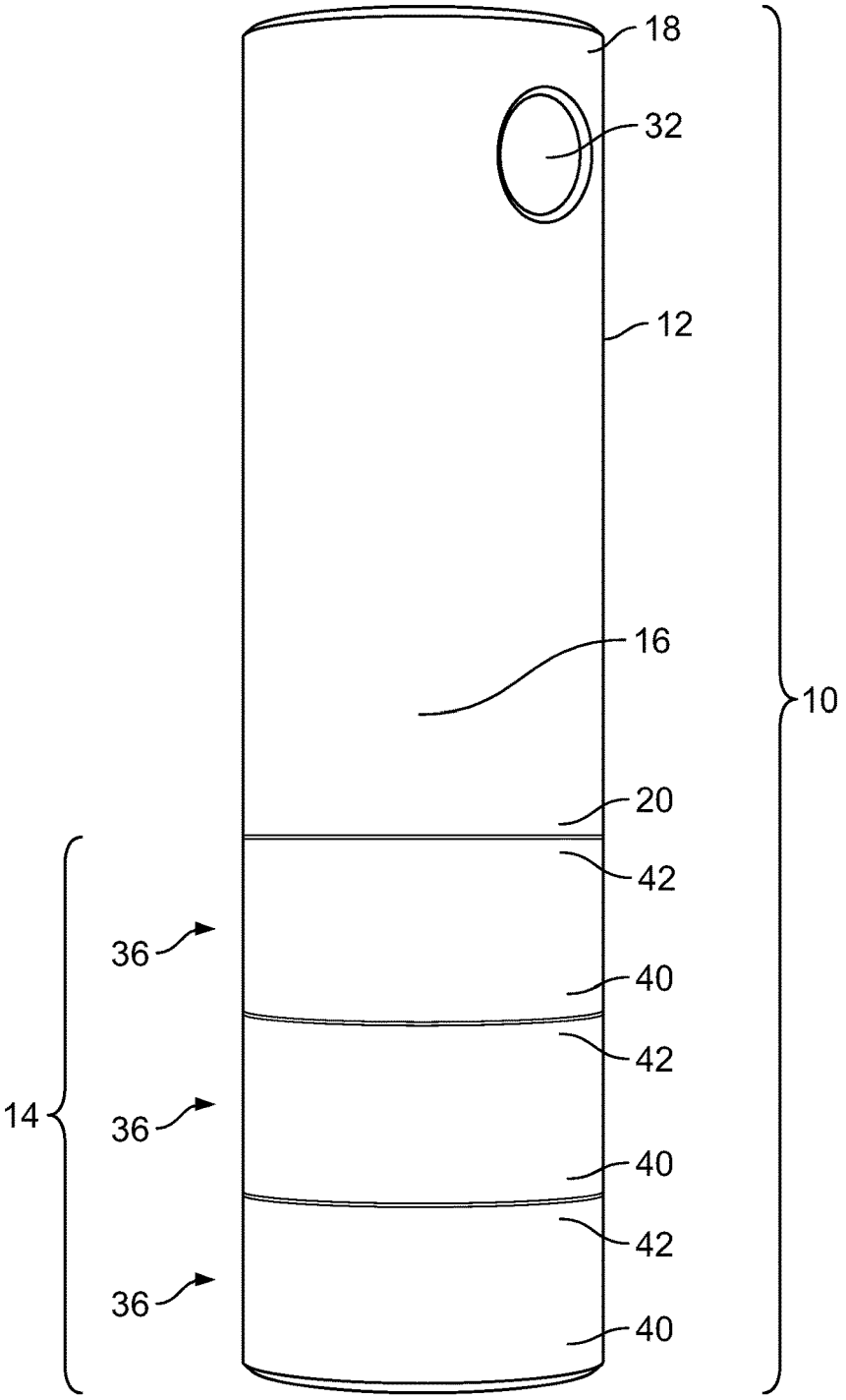
FIG. 5 illustrates a back perspective view of the device of FIG. 1 in accordance with one embodiment of the present invention.
Figure 6:
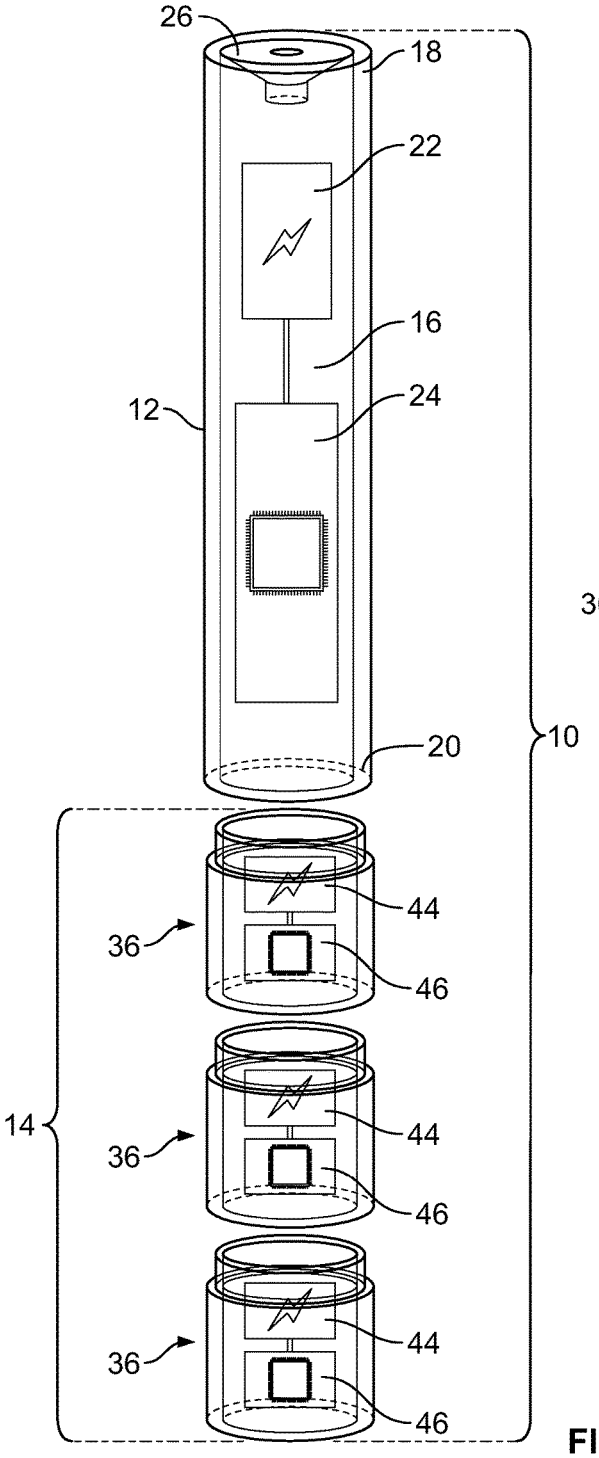
FIG. 6 illustrates the internal components of the device of FIG. 1 in accordance with one embodiment of the present invention.

As depicted in FIG. 6, the base 10 includes at least a rechargeable base power source 22 and a base controller 24 connected thereto. Base power source 22 enables extended operation of the base 10 and elements 14 while the base controller 24 is configured for wireless communication with a wireless communication device such as a smartphone, PDA, laptop and the like. FIGS. 1 & 3 further illustrate a speaker 26 coupled to at least one or both of the base power source 22 and the base controller 24. The mobile security device 10 further includes a jack 28 (best viewed in FIG. 4). Jack 28 is adapted to removeably receive a USB charging cord 30 to charge the base power source 22.

In at least one embodiment, the base 12 further includes at least one camera 32 coupled to at least one of the base power source 22 and the base controller 24. Further, the base 12 further includes at least one touch pad 34 communicating with at least the base controller 24 to select different modes of operation.

In at least one embodiment, the one or more elements 14 comprise one or more sensors 36. FIGS. 1-5 illustrate three sensors 36 coupled to the base 12 at or proximate first end 20. While three sensors 36 are illustrated, more or less than three sensors 36 are contemplated. FIG. 1-5 illustrates a first sensor 36 removably coupled to the first end 20 of base 12 and communicating therewith, a second sensor 36 removably coupled to the first sensor 36 proximate first end 20 and a third sensor 36 removably coupled to the second sensor 36 proximate first end 20. Each of the sensors 36 is about 1" in length.

Figure 7:
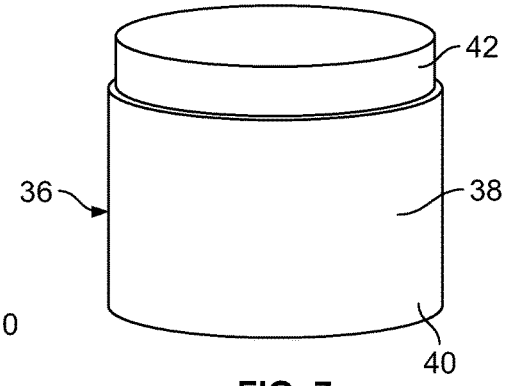
FIG. 7 illustrates a perspective view of the sensor of FIG. 1 in accordance with one embodiment of the present invention.

FIG. 7 depicts the sensor 36 having a housing 38 defining a first end 40 and a second end 42. FIG. 7 depicts the sensor 36 having a cylinder like shape which minimizes "catching" on bag/contents, minimizing the risk of damage to the bag/contents, although other shapes are contemplated. Further housing 38 has an anti-slip exterior finish that resists scratches. It should be appreciated that the dimensions and exterior are illustrative only, and other sizes and dimensions are contemplated. Each sensor 36 has a first end 40 and second end 42 opposite the first end 40, where the second end 42 is adapted to removably connect or couple to the base 12 or another sensor 36. FIGS. 1-5 depict the second end 42 of the first sensor 36 is coupled to or proximate the first end 20, the second end 42 of the second sensor 36 is coupled to the first end 40 of the first sensor 36 proximate end 20, while the second end 42 of the third sensor 36 is coupled to the first end 40 of the second sensor 36.

As depicted in FIG. 6, each of the sensors 36 includes at least a rechargeable sensor power source 44 and a sensor controller 46 connected thereto. Each sensor power source 44 enables extended operation of the sensor 36 while the sensor controller 46 is configured for wireless communication to a wireless communication device such as a smartphone, PDA, laptop and the like.

In at least one embodiment, the one or more elements 14 comprise one or more sensors 36. FIGS. 1-5 illustrate three sensors 36 coupled to the base 12 at or proximate first end 20. While three sensors 36 are illustrated, more or less than three sensors 36 are contemplated. FIGS. 1-5 illustrates a first sensor 36 removably coupled to the first end 20 of base 12 and communicating therewith, a second sensor 36 removably coupled to the first sensor 36 proximate first end 20 and a third sensor 36 removably coupled to the second sensor 36 proximate first end 20.

FIGS. 8A-8F depict a mobile security system, generally designated 100, in accordance with one embodiment of the present invention. In at least one embodiment, the mobile security system 100 operates in one or more modes. FIGS. 8A-8E depicts the mobile security system 100 includes a mobile device 110 operating in a TRAVEL mode or proximity monitoring one or more proximity tags 160. In this embodiment the mobile security system watches the user's bags and/or belongings to be sure they stay close.

Figure 8A:
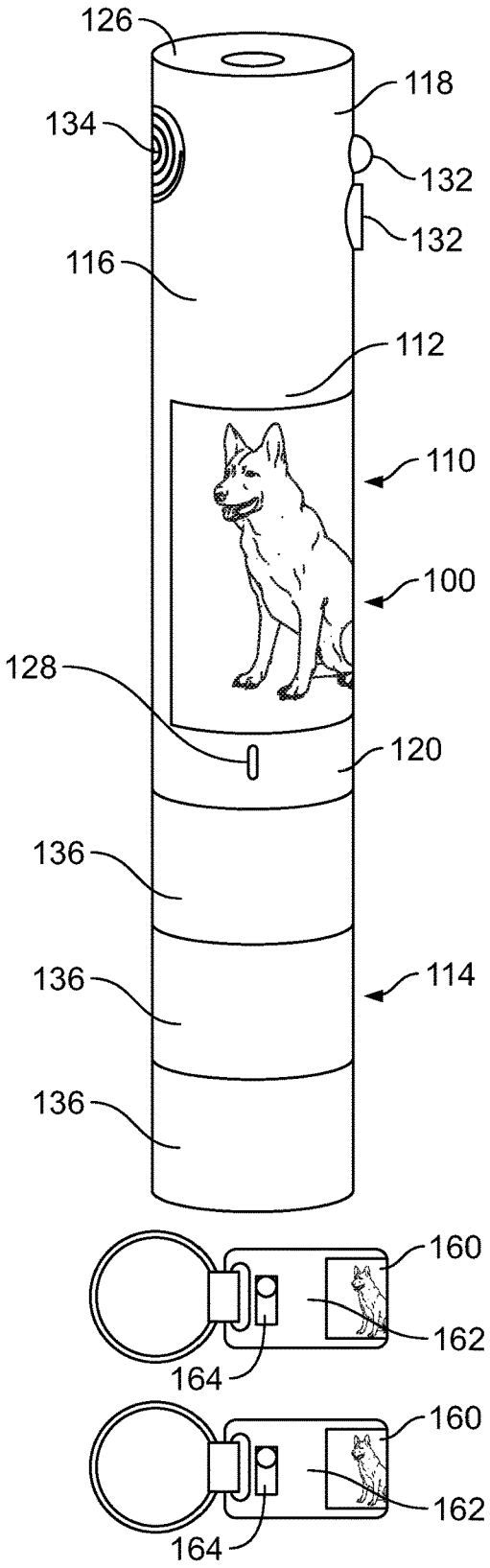
FIGS. 8A-8F illustrate another embodiment of the device used in a TRAVEL mode with the a plurality of proximity tags in accordance with one embodiment of the present invention.
Figures 8B, 8C:
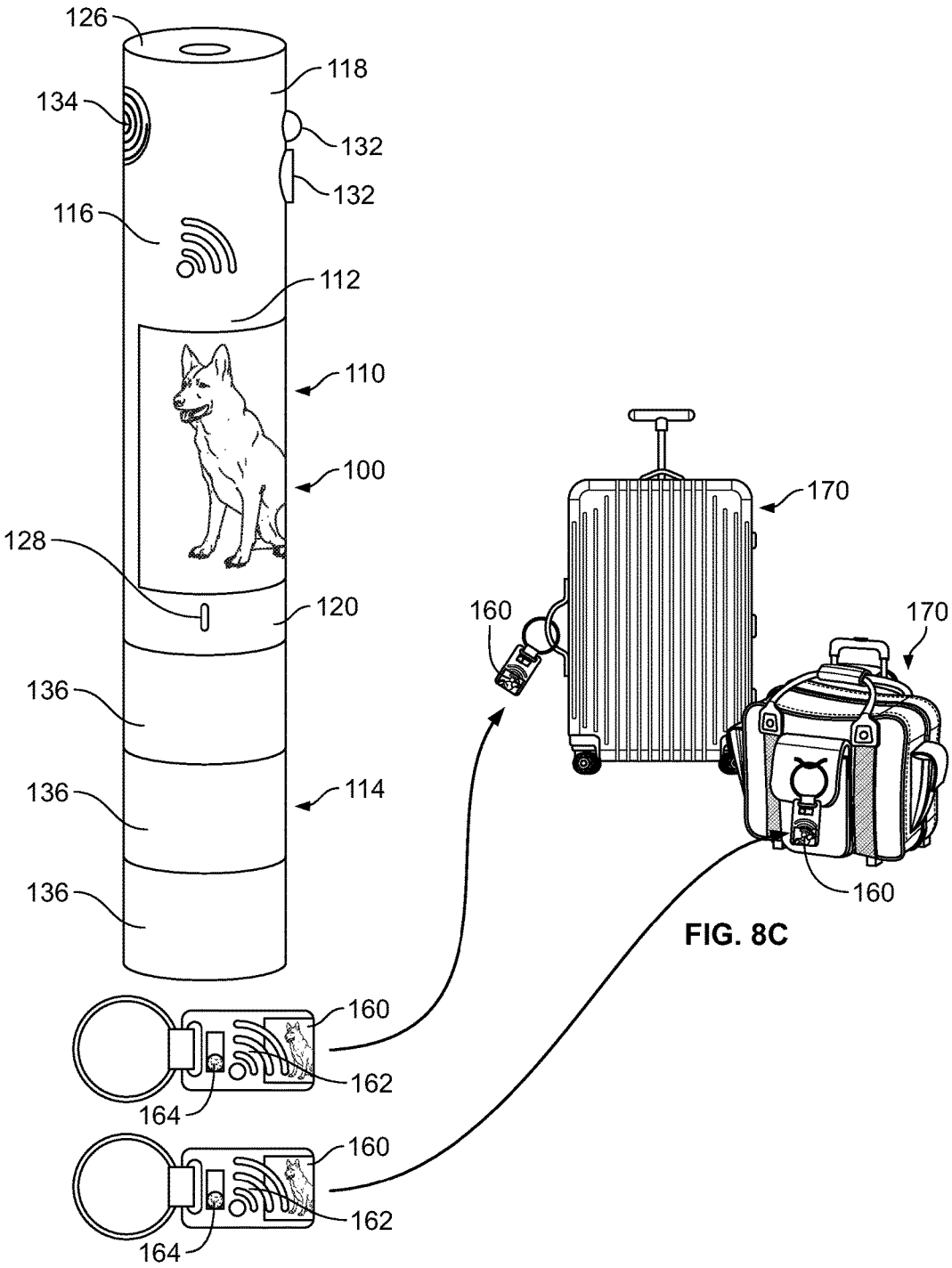
Figure 8D:
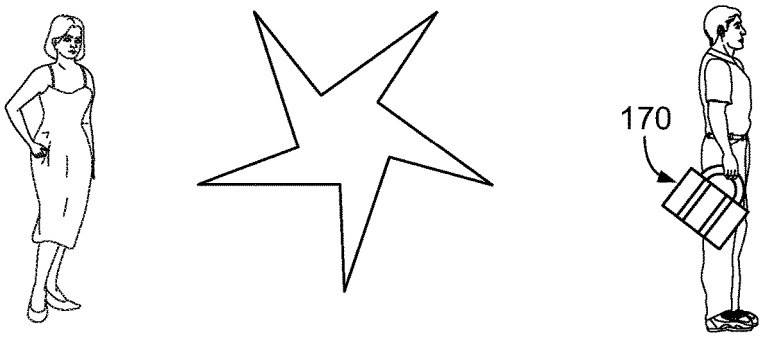
Figure 8E:
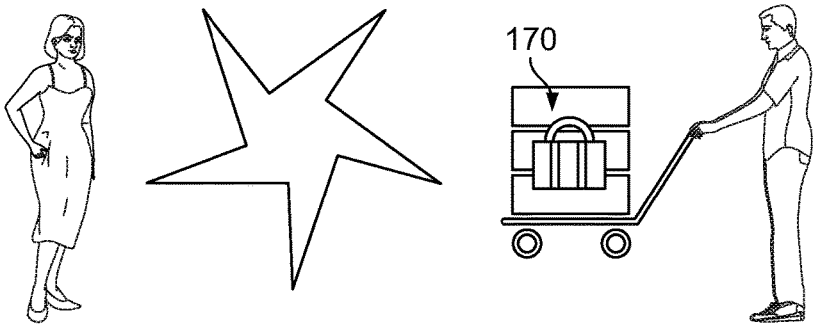
Figure 8F:
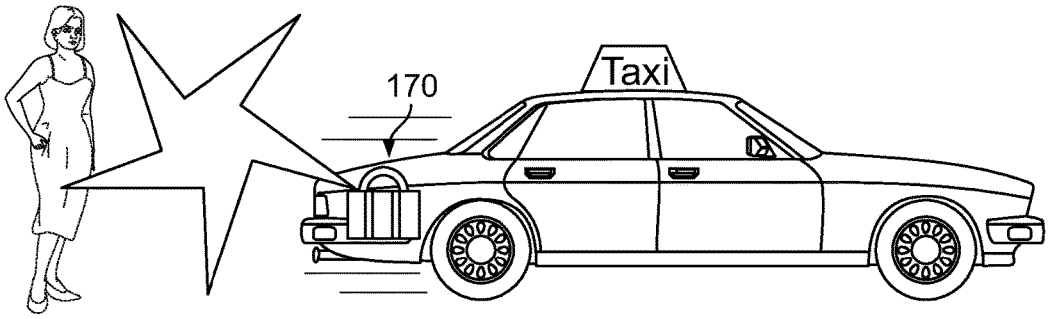

FIGS. 8A-8B depict the base 112 having a housing 116 defining a first end 120 and a second end 118. FIG. 8A-8B depicts the mobile security device 110 having an elongated, cylindrical-like shape which minimizes "catching" on bag/contents, minimizing the risk of damage to the bag/contents, although other shapes are contemplated. Further housing 116 has an anti-slip exterior finish that resists scratches. It should be appreciated that the dimensions and exterior are illustrative only, and other sizes and dimensions are contemplated.

Similar to the device 10 above, device 110 includes a base 112 having at least a rechargeable base power source 22 and a base controller 24 connected thereto. Base power source 22 enables extended operation of the base 112 and elements 114 while the base controller 24 is configured for wireless communication. FIGS. 8A-8B further illustrate a speaker 126 coupled to at least one or both of the base power source 22 and the base controller 24. The mobile security device 110 further includes a jack 128 proximate the first end 120. Jack 128 is adapted to removably receive a USB charging cord to charge the base power source 22.

In at least one embodiment, the base 112 further includes at least one camera 132 coupled to at least one of the base power source 22 and the base controller 24. Further, the base 112 further includes at least one touch pad 134 communicating with at least the base controller 24.

In at least one embodiment, the one or more elements 114 comprise one or more sensors 136, the at least one or more sensors 136 configured to provide at least one of motion sensing, CO2/smoke sensing, vibration sensing, light sensing, temperature/humidity sensing and the like. FIGS. 8A-8B illustrate three sensors 136 similar to the sensors described above coupled to the base 112 at or proximate first end 120. While three sensors 136 are illustrated, more or less than three sensors 136 are contemplated. FIGS. 8A-8B illustrates a first sensor 136 removably coupled to the first end 120 of base 112 and communicating therewith, a second sensor 136 removably coupled to the first sensor 136 proximate first end 120 and a third sensor 136 removably coupled to the second sensor 136 proximate first end 120. Each of the sensors 136 is about 1" in length.

Figure 9:
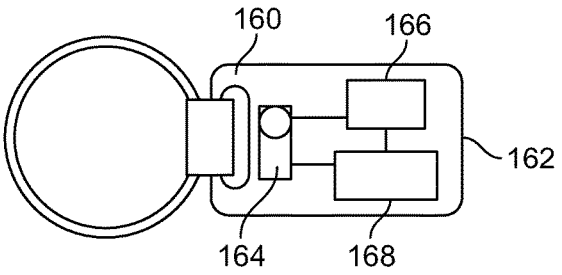
FIG. 9 illustrates the internal components of the proximity tags.

Additionally, the mobile security system 100 illustrated in FIGS. 8A-8B includes a plurality of proximity tags 160 configured for removable attachment to a bag and/or belongings 170 (see FIG. 8C) and communicating with the base 112. While two proximity tags 160 are illustrated, more or less than two proximity tags 160 are contemplated. As depicted in FIG. 9 each of the proximity sensors 160 includes at least a proximity tag housing 162, an on/off switch 164, a proximity tag power source 166 and a proximity tag controller 168 connected thereto. Each proximity tag power source 166 enables extended operation of the proximity tag 160 when turned on or enabled using on/off switch 164 while the proximity tag controller 168 is configured for wireless communication with the base for example.

The at least one proximity tag 160 is configured for attachment to the bag or belongings 170 and communicating with the base 112 as illustrated in FIG. 8C. The at least one proximity tag 160 is configured to provide approximate distance-from-base information. In operation, the at least one proximity tag 160 is independently powered-up moving the at least one on/off switch 164 (See FIG. 8B). The at least one proximity tag 160 is placed on or concealed in the bag and/or belongings 170 as shown in FIG. 8C. The system 100 initiates proximity monitoring from the base 112. The system 100 arms the base 110 and the at least one proximity tag 160 and monitors the at least one proximity tag 160 for proximity states. The system 100 enables base ALARMing and ALERTing when changes in proximity state of the at least one proximity tag 160 occur.

In at least one embodiment, the mobile security system 100 initiates proximity monitoring from the base 112 by powering up the base 112 and selecting proximity monitoring mode or TRAVEL mode from a plurality of modes using the at least one touch pad 134 communicating with at least the base controller 24. In this embodiment, arming the base 112 and the at least one proximity tag 160 comprises the base 112 searching for, finding, and communicating with the at least one proximity tag 160. Monitoring the at least one proximity tag 160 for proximity states (illustrated in FIGS. 8D-8F) comprises monitoring the at least one proximity tag 160 in a passive interaction mode; detecting if the at least one proximity tag 160 enters an in-range state; detecting if the at least one proximity tag 160 enters an out-of-range state; detecting if the at least one proximity tag 160 enters an in-motion state; and rapid detection of change in a proximity state. System 100 enables base 112 ALARMing and ALERTing when changes in proximity state of the at least one proximity tag 160 occur which includes giving audio feedback via base speaker 126 (ALARMing) and the base 112 sending information about proximity state via SMS, e-mail, and/or other communication pathway (ALERTing) to a wireless communication device such as a smartphone, PDA, laptop and the like. The securing method of claim 21 wherein disarming the base 112 and the at least one proximity tag 160 includes powering down the base 112; and physically detaching the at least one proximity tag 160 from the bag or belongings 170.

FIGS. 10A-10E depict a mobile security device, generally designated 210, in accordance with one embodiment of the present invention. In at least one embodiment, the mobile security system 210 operates in one or more modes. FIGS. 10A-10E depicts the mobile security device 210 operating in a one of a SURVAIL or SECURE mode.

Figure 10A:
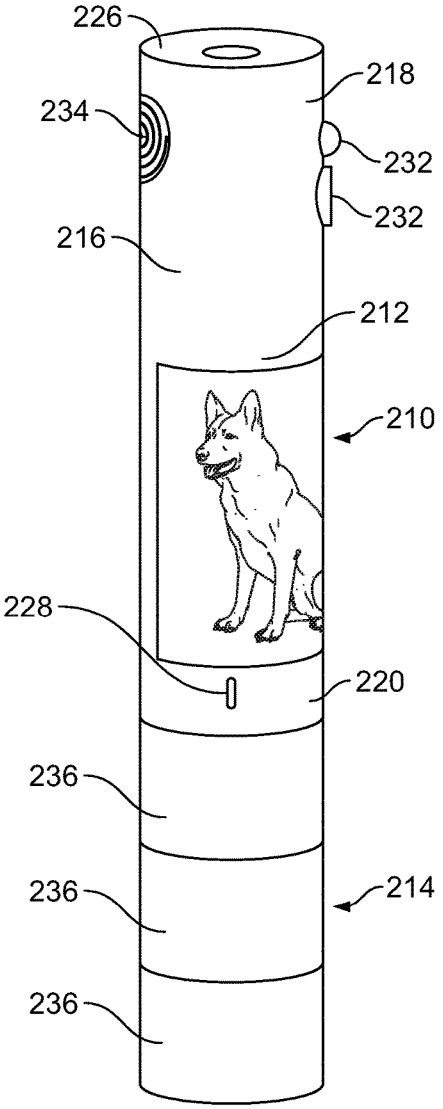
FIGS. 10A-10E illustrate the embodiment of the device with the sensors deployed in a SURVAIL/SECURE mode in accordance with one embodiment of the present invention.
Figure 10B:
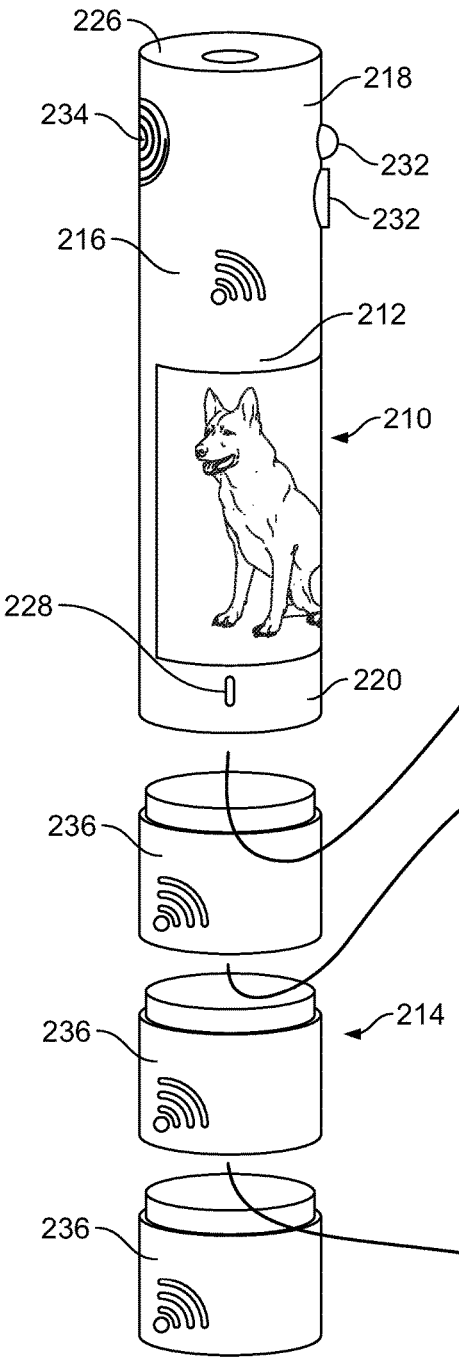
Figure 10C:
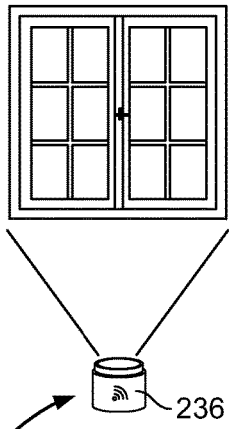
Figure 10D:
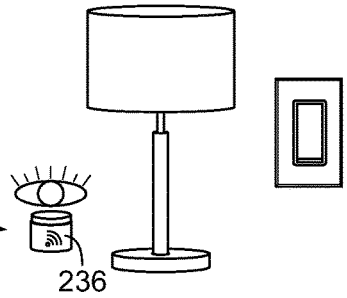
Figure 10E:
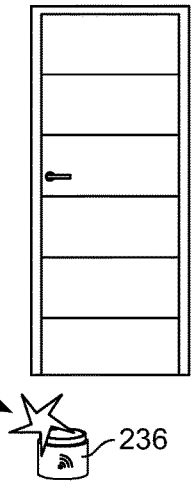

FIGS. 10A-10B depict the base 212 having a housing 216 defining a second end 218 and a first end 220. FIG. 10A-10B depict the mobile security device 210 having an elongated, cylindrical-like shape which minimizes "catching" on bag/contents, minimizing the risk of damage to the bag/contents, although other shapes are contemplated. Further housing 216 has an anti-slip exterior finish that resists scratches. It should be appreciated that the dimensions and exterior are illustrative only, and other sizes and dimensions are contemplated.

Similar to the device 10 above, device 210 includes a base 212 having at least a rechargeable base power source 22 and a base controller 24 connected thereto. Base power source 22 enables extended operation of the base 212 and elements 214 while the base controller 24 is configured for wireless communication. FIGS. 10A-10B further illustrate a speaker 226 coupled to at least one or both of the base power source 22 and the base controller 24. The mobile security device 210 further includes a jack 228 proximate the first end 220. Jack 228 is adapted to removably receive a USB charging cord to charge the base power source 22.

In at least one embodiment, the base 212 further includes at least one camera 232 coupled to at least one of the base power source 22 and the base controller 24. Further, the base 212 further includes at least one touch pad 234 communicating with at least the base controller 24.

In at least one embodiment, the one or more elements 214 comprise one or more sensors 236 configured to provide at least one of motion sensing, CO2/smoke sensing, vibration sensing, light sensing, temperature/humidity sensing, and the like. FIGS. 10A-10B illustrate three sensors 236 similar to the sensors describe above coupled to the base 212 at or proximate second end 218. While three sensors 236 are illustrated, more or less than three sensors 236 are contemplated. FIGS. 10A-10B illustrates a first sensor 236 removably coupled to the first end 220 of base 212 and communicating therewith, a second sensor 236 removably coupled to the first sensor 236 proximate first end 220 and a third sensor 236 removably coupled to the second sensor 236 proximate first end 220. Each of the sensors 236 is about 1" in length.

In at least one embodiment, the method for providing security using the mobile security device 210 includes the at least one sensor removably coupled to the first end of the base and communicating therewith, the at least one sensor configured to provide at least one of motion sensing, CO2/smoke sensing, vibration sensing, light sensing, and temperature/humidity sensing, the at least one sensor similar to any of the sensors discussed above. The method includes detaching the at least one sensor 236 auto-activating the sensor 236. The at least one sensor 236 is positioned proximate at least one risk point in a security zone (See FIGS. 10C-10E).

The method further includes initiating at least one of a watch-only and watch-and-warn sensor monitoring from the base 212; arming the base 212 and the at least one sensor 236; monitoring the at least sensor 236 for heartbeats; monitoring the at least sensor 236 for security events; performing at least one of base ALERTing, base ALARMing and base ALERTing and base ALARMing when missed heartbeats or security events occur in the at least one sensor 236; and disarming the base 212 and the at least one sensor 236.

The method further includes auto-activating the at least one sensor 236 which includes physically detaching the at least one sensor 236 from the base housing 216 (See FIG. 10B) so that the sensor 236 automatically powers up and becomes receptive to communication from the base 212. The at least one sensor 236 is positioned to at least one risk point in a security zone comprises placing the at least one sensor 236 in a location to detect changes in the local environment likely to represent a security issue related to at least one of windows, doors, light sources, water sources, fire sources, gas sources and the like (See FIGS. 10C-10E).

The securing method includes initiating watch-only sensor monitoring from the base 212 comprises powering up the base 212 and selecting watching-only mode or SURVAIL mode from a plurality of modes using the at least one touch pad 234 communicating with at least the base controller 24. In another embodiment, initiating watch-and-warn sensor monitoring from the base 212 comprises powering up the base 212 and selecting watching-and-warn mode or SECURE mode from a plurality of modes using the at least one touch pad 234 communicating with at least the base controller 24. Arming the base 212 and the at least one sensor 236 include the base 212 searching for, finding, and communicating with the at least one sensor 236.

In at least one embodiment, monitoring the at least one sensor 236 for heartbeats includes the at least one sensor 236 customizing the base's heartbeat interaction with the sensor 236; the base 212 maintaining an active communication channel with the at least one sensor 236; and the base 212 periodically pinging the at least one sensor 236 and the at least one sensor 236 responding to the pinging over an active communication channel.

In another embodiment, monitoring the at least one sensor 236 for security events comprises the at least one sensor 236 monitoring for changes in local environment likely to represent a security issue; the at least one sensor 236 sending information about the security event in a standardized form to the base 212 via an active communication channel; and the base 212 receiving security event information in standardized form from the at least one sensor 236 via the active communication channel.

The securing method further includes base ALERTing when missed heartbeats or security events occur in the at least one sensor 236 includes the base 212 sending information about the at least one sensor's missed heartbeat or security event info via SMS, e-mail, and/or other communication pathway (ALERTing) to a wireless communication device such as a smartphone, cellphone, PDA, laptop and the like. Alternatively, the securing method includes base ALERTing when missed heartbeats or security events occur in the at least one sensor 236 comprises giving audio feedback via base speaker 226 (ALARMing) and the base 212 sending information about the at least one sensor's missed heartbeat or security event info via SMS, e-mail, and/or other communication pathway (ALERTing) to a wireless communication device such as a smartphone, cellphone, PDA, laptop and the like. Disarming the base 212 and the at least one sensor 236 comprises powering down the base 212; and physically reattaching the at least one sensor 236 to the base housing 216 which results in auto-power-down of the at least one sensor 236.

Figure 11:
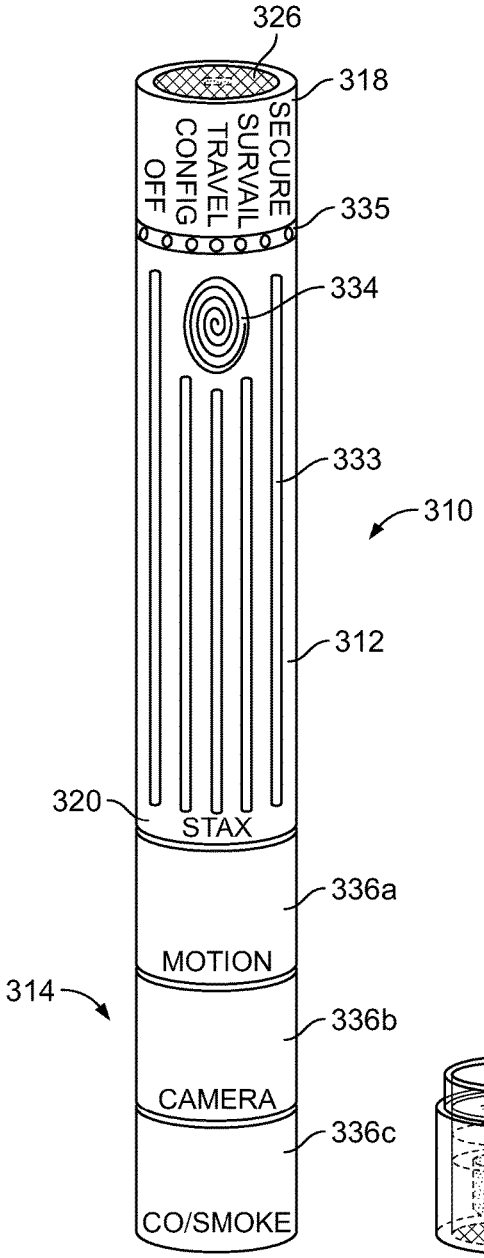
FIG. 11 illustrates another embodiment of the device.

FIG. 11 illustrates another embodiment of the mobile security device 310 including a base 312 and multiple elements 314 comprising three sensors 336*a*, 336*b*, and 336*c*. The base 312 has a housing 316 defining a second end 318 and a first end 320. The housing 316 has longitudinally extending anti-roll ridges 333. The base 312 further includes a touch pad 334 similar to those described above. The base 312 also includes a UI select ring 335 and a speaker 326.

Figure 12A:
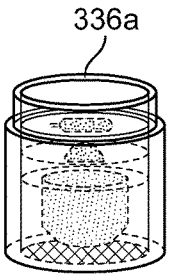
FIGS. 12*a*-12*c* respectively illustrate the three sensors of the device of FIG. 11.
Figure 12B:
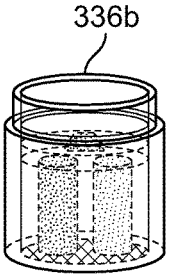
Figure 12C:
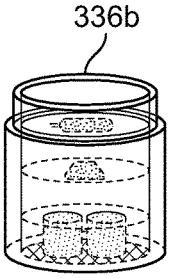

The sensor 336*a*, shown in FIG. 12*a*, is coupled to the base 312 at the second end 320 of the base 312 and is configured to provide motion sensing. The sensor 336*a* includes a coin battery, a motion sensor, and a Bluetooth low-energy system-on-chip. The sensor 336*b*, shown in FIG. 12*b*, is coupled to the sensor 336*a* and is configured to provide camera functionality. The sensor 336*b* includes a Bluetooth low-energy system-on-chip, a camera battery, a still image camera, and an LED for illumination. The sensor 336*c* is coupled to the sensor 336*b* and is configured to provide carbon monoxide and smoke sensing. The sensor 336*c* includes a coin battery, a Bluetooth low-energy system-on-chip, a smoke sensor, and a carbon monoxide sensor.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A mobile security device comprising:

a handheld base comprising a housing, a base controller configured for wireless communication, and a base power source electrically connected to the base controller to power the base controller; and a sensor module removably attachable to the housing of the base, the sensor module comprising:

a sensor;

a sensor module controller configured to wirelessly communicate with the base controller; and a sensor module power source electrically connected to the sensor module controller to power the sensor module controller.

2. The mobile security device of claim 1, wherein the base power source and the sensor module power source are rechargeable power sources.

3. The mobile security device of claim 1, wherein the base further comprises an input device communicatively connected to the base controller and configured to enable selection of one of multiple different operating modes.

4. The mobile security device of claim 3, wherein the input device comprises a touch panel.

5. The mobile security device of claim 1, wherein the housing comprises a cylindrical base housing and the sensor module further comprises a cylindrical sensor module housing.

6. The mobile security device of claim 5, wherein an outer diameter of the base housing is about the same as an outer diameter of the sensor module housing.

7. The mobile sec device of claim 1, further comprising a second sensor module removably attachable to the sensor module, the second sensor module comprising:

a second sensor;

a second sensor module controller configured to wirelessly communicate with the base controller; and a second sensor module power source electrically connected to the second sensor module controller to power the second sensor module controller, wherein the sensor is a first type of sensor and the second sensor is a second type of sensor different from the first type of sensor.

8. The mobile security device of claim 1, wherein the sensor includes one of: a motion sensor, a carbon monoxide sensor, a smoke sensor, a light sensor, a temperature sensor, and a humidity sensor.

9. The mobile security device of claim 1, wherein the sensor module controller is configured to switch from a sensor module disarmed state to a sensor module armed state responsive to detachment of the sensor module from the base.

10. The mobile security device of claim 9, wherein the base controller is configured to, responsive to detachment of the sensor module from the base, establish wireless communications with the sensor module controller.

11. The mobile security device of claim 10, wherein the base controller is configured to switch from a base disarmed state to a base armed state responsive to detachment of the sensor module from the base.

12. The mobile security device of claim 9, wherein the sensor module controller is configured to switch from the sensor module armed state to the sensor module disarmed state responsive to reattachment of the sensor module to the base.

13. The mobile security device of claim 9, wherein the sensor module controller is configured to, when in the sensor module armed state:

monitor feedback received from the sensor;

determine whether a security event has occurred based on the feedback; and responsive to determining that the security event has occurred, send security event occurrence information to the base controller.

14. The mobile security device of claim 13, wherein the base controller is configured to, responsive to receiving the security event occurrence information from the sensor module controller, cause a notification.

15. The mobile security device of claim 14, wherein the base further comprises a speaker communicatively connected to the base controller, and wherein the base controller is configured to cause the notification by causing the speaker to output a sound.

16. The mobile security device of claim 14, wherein the base controller is configured to cause the notification by wirelessly sending information associated with the security event to a mobile device.

17. The mobile security device of claim 16, further comprising a second sensor module removably attachable to the sensor module, the second sensor module comprising:

a second sensor, wherein the sensor is a first type of sensor and the second sensor is a second type of sensor different from the first type of sensor;

a second sensor module controller configured to wirelessly communicate with the base controller; and a second sensor module power source electrically connected to the second sensor module controller to power the second sensor module controller, wherein the second sensor module controller is configured to switch from a second sensor module disarmed state to a second sensor module armed state responsive to detachment of the second sensor module from the first sensor module.

18. The mobile security device of claim 17, wherein the second sensor module is removably attachable to the base.

19. The mobile security device of claim 17, wherein the base controller is configured to, responsive to detachment of the second sensor module from the sensor module, establish wireless communications with the second sensor module controller.

20. The mobile security device of claim 17, wherein the second sensor module controller is configured to switch from the second sensor module armed state to the second sensor module disarmed state responsive to reattachment of the second sensor module to the base.

21. The mobile security device of claim 17, wherein the second sensor module controller is configured to, when in the second sensor module armed state:

monitor feedback received from the second sensor;

determine whether a second security event has occurred based on the feedback; and responsive to determining that the second security event has occurred, send second security event occurrence information to the base controller.

22. The mobile security device of claim 21, wherein base controller is configured to, responsive to receiving the second security event occurrence information from the second sensor module controller, cause a second notification.

23. The mobile security device of claim 22, wherein the base further comprises a speaker communicatively connected to the base controller, and wherein the base controller is configured to cause the second notification by causing the speaker to output a second sound.

24. The mobile security device of claim 22, wherein the base controller is configured to cause the second notification by wirelessly sending second information associated with the second security event to a mobile device.

25. The mobile security device of claim 22, wherein the base further comprises a speaker communicatively connected to the base controller, wherein the base controller is operable in one of multiple different operating modes, wherein when in a first one of the operating modes, the base controller is configured to cause the notification by causing the speaker to output a sound and to cause the second notification by causing the speaker to output a second sound, and wherein when in a second one of the operating modes, the base controller is configured to cause the notification by sending information associated with the security event to a mobile device and to cause the second notification by sending second information associated with the security event to the mobile device.

26. The mobile security device of claim 14, wherein the base further comprises a speaker communicatively connected to the base controller, wherein the base controller is operable in one of multiple different operating modes, wherein when in a first one of the operating modes, the base controller is configured to cause the notification by causing the speaker to output a sound, and wherein when in a second one of the operating modes, the base controller is configured to cause the notification by sending information associated with the security event to a mobile device.

27. A mobile security device comprising:

a handheld base comprising a base controller configured for wireless communication and a base power source electrically connected to the base controller to power the base controller;

a sensor module removably attachable to the base, the sensor module comprising:

a sensor;

a sensor module controller configured to wirelessly communicate with the base controller; and a sensor module power source electrically connected to the sensor module controller to power the sensor module controller; and a proximity tag comprising:

a proximity tag controller configured to wirelessly communicate with the base controller; and a proximity tag power source electrically connected to the proximity tag controller to power the proximity tag controller, wherein the base controller is configured to monitor the proximity tag for a change in proximity state and to cause a notification responsive to determining a proximity state change.

28. The mobile security device of claim 27, wherein the base controller is configured to cause the notification responsive to determining that the proximity tag changes to an out-of-range state.

29. The mobile security device of claim 27, wherein the base controller is configured to cause the notification responsive to determining that the proximity tag changes to an in-motion state.

30. The mobile security device of claim 27, wherein the proximity tag includes an input device operable to switch the proximity tag between on and off modes.

31. The mobile security device of claim 27, wherein the base further comprises a speaker communicatively connected to the base controller, and wherein the base controller is configured to cause the notification by causing the speaker to output a sound.

32. The mobile security device of claim 27, wherein the base controller is configured to cause the notification by sending information associated with the security event to a mobile device.

* * * * *